US005224558A

United States Patent [19]

Lee

[11] Patent Number: 5,224,558

[45] Date of Patent: Jul. 6, 1993

[54] DOWN HOLE DRILLING TOOL CONTROL MECHANISM

[76] Inventor: Paul Lee, Suite 1650, 736 - 6th Avenue, S.W., Calgary, Alberta, Canada, T2P 3T7

[21] Appl. No.: 804,114

[22] Filed: Dec. 6, 1991

[30] Foreign Application Priority Data

Dec. 12, 1990 [CA] Canada ..... 2032022

[51] Int. Cl.[5] ..... E21B 17/10

[52] U.S. Cl. ..... 175/325.4; 175/326

[58] Field of Search ..... 175/73, 97, 98, 325.2, 175/325.4, 325.5, 321; 166/241, 212

[56] References Cited

U.S. PATENT DOCUMENTS

| | | | |
|---|---|---|---|
| 3,371,729 | 3/1968 | Carr | 175/321 |
| 3,572,450 | 3/1971 | Thompson | 175/325.4 |
| 4,270,619 | 6/1981 | Base | 175/325.4 |
| 4,428,626 | 1/1984 | Blau et al. | 175/325.4 |
| 4,557,339 | 12/1985 | Falkner et al. | 175/325.4 |
| 4,572,305 | 2/1986 | Swietlik | 175/325.4 |
| 4,848,490 | 7/1989 | Anderson | 175/325.4 |
| 4,854,403 | 8/1989 | Ostertag et al. | 175/325.4 |

*Primary Examiner*—Ramon S. Britts
*Assistant Examiner*—Frank S. Tsay
*Attorney, Agent, or Firm*—Zarley, McKee, Thomte, Voorhees, & Sease

[57] ABSTRACT

A down hole drilling tool activating mechanism comprising a drill string sub connectable between adjacent lengths of drill string pipe which provides a hollow housing with a central bore, a mandrel having a central bore positioned within the bore of said drill sub and moveable longitudinally within said sub bore between a deactivated position and an activated position and the reverse, said mandrel having a first portion of large diameter exposed to pressure in the central bore upstream from said mandrel and a second portion having a smaller diameter than said first portion exposed to pressure in said bore downstream from said mandrel, and having a seal between the small diameter portion and the bore of said drill sub to isolate said large diameter portion from pressure downstream of said mandrel. Spring means is located between the small diameter of the mandrel and the wall of the drill sub tending to urge the mandrel in a first position against the pressure on said large diameter portion. A ring is provided in sealed relationship between the mandrel and the drill sub having a check valve set to predetermine the minimum pressure at which fluid will flow there through and controlling the pressure exerted on the large diameter portion of the mandrel. A second check valve determines a pressure at which fluid may flow in the opposite direction under pressure from the spring bias means. The mandrel has cam means adapted to engage follower means to control activation and deactivation of the tool.

8 Claims, 3 Drawing Sheets

DOWN HOLE DRILLING TOOL CONTROL MECHANISM

This invention relates to improvements in oil well drilling equipment. In particular, it relates to an improvement in down hole mechanisms which will allow the drill operator to activate or deactivate devices which assist in the drilling operation.

BACKGROUND OF THE INVENTION

Modern drilling techniques for oil and gas wells have become very sophisticated in recent years. Original equipment involved only the bit on the end of a drill string composed of lengths of drill pipe having a hollow core through which fluids such as drilling mud could be circulated to remove cuttings. As techniques developed, certain down hole equipment was designed to improve the performance of such drills. For instance, stabilizers are used to maintain proper alignment of the drill string so as to prevent deviation or to change the direction of a hole.

In some cases, the rotary drilling function is performed by a down hole motor at the bottom of the drill string activated by the flow of fluid. These devices require "dump subs" to allow the drilling fluid to be bypassed when the pipe is being withdrawn so that mud is not spilled at the top of the string.

Other devices used include down hole packers, blowout preventers and mud hammers which use vibratory force to increase the efficiency of the drilling operation.

Many of these devices need to be activated at certain times, depending on the circumstances, while they are in the hole. In other cases, the devices need to be deactivated to run them into the hole and activated once they are in position, or deactivated in order to withdraw them from the hole. Since many holes are deep and time is costly, it is always an undesirable expense to withdraw this equipment from the hole when it needs to be adjusted.

Thus, it is important to develop mechanisms by which down hole devices such as stabilizers, packers, etc. may be engaged or disengaged by operations which can be conducted on the drill floor.

Some of these devices are operated by using the blocks supporting the drill string to change the weight which is applied to the bottom of the drill string at the bottom of the hole. Other devices have been developed which operate by changing the pressure applied to the fluid which is circulated through the drill string in order to activate or deactivate the device.

Many of these devices are difficult to operate because changing weight or pressure will activate or deactivate them at an inappropriate time. Some devices are difficult to operate because it is not easy to determine the weight or pressure which is being applied at the bottom of the drill string. Others require that the conditions for activation of the device remain relatively constant and these conditions may not be ideal for carrying on the drilling operation.

SUMMARY OF THE INVENTION

It is the purpose of this invention to provide a control mechanism whereby down hole devices such as stabilizers, mud hammers, packers, dump subs etc. may be activated or deactivated repeatedly without withdrawing the equipment from the hole.

It is a further object of this invention to provide a control mechanism which can be engaged and will remain engaged while ordinary drilling proceeds.

It is a further purpose of this invention to provide a control mechanism which can be engaged or disengaged with a reasonable degree of certainty by the operator of the drill rig.

These objects and other advantages are sought to be achieved by the present invention which provide a down hole drilling tool activating mechanism comprising a will string sub connectable between adjacent lengths of drill string pipe which provides a hollow housing with a central bore, a mandrel having a central bore positioned within the bore of said drill sub and moveable longitudinally within said sub bore between a deactivated position and an activated position and the reverse, said mandrel having a first portion of large diameter exposed to pressure in the central bore upstream from said mandrel and a second portion having a smaller diameter than said first portion exposed to pressure in said bore downstream from said mandrel, and having a seal between the small diameter portion and the bore of said drill sub to isolate said large diameter portion from pressure downstream of said mandrel. Spring means is located between the small diameter of the mandrel and the wall of the drill sub tending to urge the mandrel in a first position against the pressure on said large diameter portion. A ring is provided in sealed relationship between the mandrel and the drill sub having a check valve set to predetermine the minimum pressure at which fluid will flow there through and controlling the pressure exerted on the large diameter portion of the mandrel. A second check valve determines a pressure at which fluid may flow in the opposite direction under pressure from the spring bias means. The mandrel has cam means adapted to engage follower means to control activation and deactivation of the tool.

BRIEF DESCRIPTION OF THE DRAWINGS

The present invention may be better understood by a description of one embodiment thereof with reference to the attached drawings in which.

DESCRIPTION OF THE PREFERRED EMBODIMENTS

Stabilizers such as shown in the illustrated embodiment are often sued to change or correct the direction of progress during drilling. The direction of a hole will be affected because the drill string is of smaller diameter than the bit to allow circulating mud and cuttings up the annulus and therefore when the drill string lies to one side of the hole it is not axially aligned and causes deviation of the hole. To counter this, stabilizers are used which are close to the diameter of the hole (but not completely circular so as to leave room to circulate mud and cuttings) so as to support the drill string closer to the center of the hole. However, stabilizers cannot be the full size of the hole or they would be difficult to run into and out of the hole during tripping. Alternatively, it may be desirable to use a stabilizer at substantially full bore (which in most cases is approximately 1/16 inch smaller than the diameter of the hole) while a reduced diameter or under gauge is desirable when the driller wishes to increase the deviation of the hole from the vertical. Therefore, adjustable stabilizers are employed which have plugs capable of being activated to extend outwardly to the full size of the diameter of the hole. Alternatively, the device may be arranged so that the stabilizer is normally at full gauge and will convert to under gauge size when activated.

Figure 1:
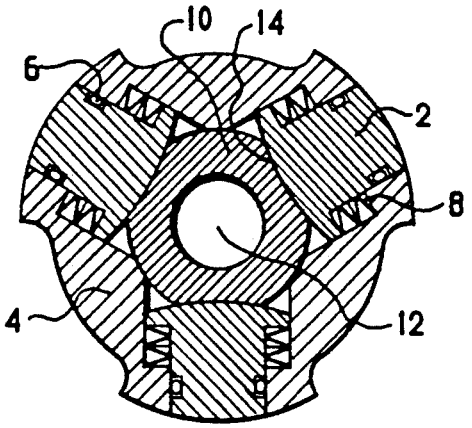
FIG. 1 is a cross section view of a drill string stabilizer with plugs of adjustable diameter.

Such a stabilizer is illustrated in cross section in FIG. 1 in which the adjustable plugs 2 point in three radial directions within the housing 4 of the stabilizer. The plugs are sealed within the housing by seals 6 and the plugs are biased in the retracted position as shown by the springs 8. Within the housing of the stabilizer is a mandrel 10 which has a central annulus 12 to allow circulation of drilling mud down through the drill string. The curved inner face of the plugs 14 are, in the retracted position, seated within a concave curvature of the mandrel. However, to activate and extend outward the plugs 2, the mandrel 10 can be moved vertically so as to engage the inner face of the plugs 14 with the full diameter of the mandrel, thereby pushing the plugs out to the full diameter of the well bore when desired.

Figure 2:
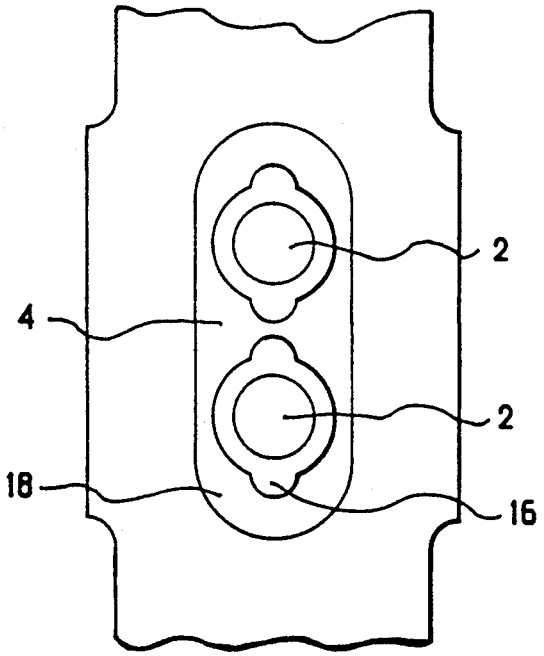
FIG. 2 is a vertical elevation view of a set of adjustable plugs shown in the device of FIG. 1.

FIG. 2 illustrates a pair of plugs 2 located one above the other at one of the three radial positions illustrated in FIG. 1. Furthermore, the plugs 2 have non-circular lugs 16 which engage recesses 18 to prevent rotation of the plugs when the drill string is in operation, thereby to avoid wear on the plugs and their seals and springs.

Figure 3:
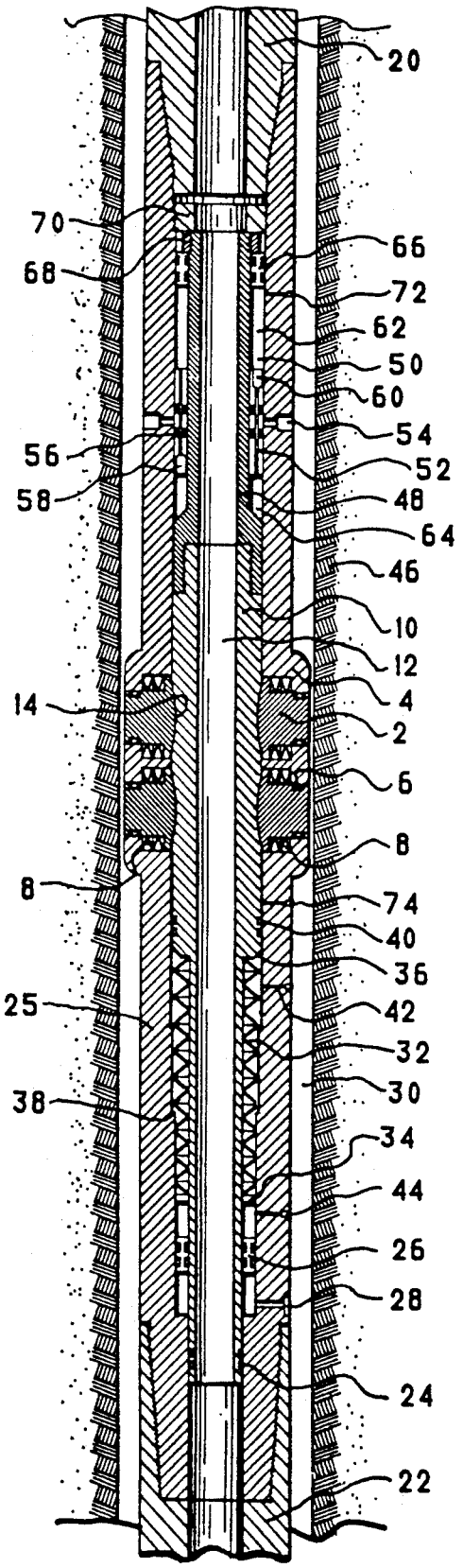
FIG. 3 is a longitudinal cross section of the stabilizer of FIG. 1 including the control mechanism which activates the plugs.

The mechanism by which the plugs of the stabilizer are activated or deactivated is illustrated in FIG. 3 in which the stabilizer housing 4 is part of a "sub" 25 which is connected between two adjacent pieces of drill pipe 20 above and 22 below.

As can be seen, the bore 12 of the mandrel 10 allows communication through the center of the drill string to the bottom of the hole. At the bottom of the mandrel 10, seals 24 prevent communication of the mud and its hydraulic pressure between the mandrel 10 and the housing 4. Above the seal 24 in the space between the mandrel and the housing, a floating piston 26 is disposed with seals against the opposite walls of the space. A port 28 exposes the space below the floating piston 26 to the same pressure as the annulus of the well bore 30.

Above the floating piston 26, a set of spring washers 32 are positioned between the mandrel and the housing, resting on a ring 34 on a shoulder of the housing. The top of the spring 32 abuts against the enlarged diameter of the mandrel at 36 so that the spring tends to bias the mandrel upwards relative to the housing of the stabilizer. An upper shoulder in the housing at 38 limits the downward movement of the mandrel by engaging the enlarged diameter 36.

Above the spring 32 seals 40 prevent communication between the gaps above and below.

The ports 42 and 44 allow for the placement of oil in the region of the spring 32.

As mentioned previously, the plugs 2 in their retracted position, rest within a concave recess of the mandrel as illustrated. However, if the mandrel is moved vertically, the full diameter will press against the curved inner surface of the plugs at 14 and cause the plugs to extend outwardly to the full diameter of the well bore 46.

Above the plugs, the mandrel has a reduced cross section 48 providing a chamber 50 in which a ring 52 is disposed and held by a pin 54. The ring is sealed against the housing and the mandrel respectively by seals 56 and is provided with check valves 58 and 60 which control the fluid between the upper chamber 62 and the lower chamber 64.

At the top of the chamber 62, a floating piston 66 is provided with seals against the inner wall of the housing and the outer wall of the mandrel. The housing is capped by a threaded ring 68 and secured within the housing by a retaining ring 70.

The chambers 62 and 64 may be filled with oil by means of the ports 72 and 74 near the upper and lower ends of the gap which is isolated above the seal 40.

In use, a stabilizer such as the embodiment illustrate would typically be run into the hole at or near the bottom of a drill string, above the bit, with the plugs retracted in the position illustrated. When the bit is at the bottom of the hole and drilling is about to begin, the plugs may be activated to center the drill string within the drill hole.

The activation of the adjustable plugs can be achieved by accelerating the mud pumps to increase the pressure at which mud is pumped down the bore 12 of the drill string and the stabilizer sub. The increased pressure will be felt through the contact between the threaded ring 68 and the retaining ring 70, because they are not sealed, and will be exerted on the floating piston 66 which will in turn exert an increased pressure on the oil in the chamber 62 causing it to flow through the check valve 60 into the chamber 64 where the increased pressure will be exerted on the increased diameter of the mandrel 10 tending to force it downwards against the upward bias of the spring 32. Depending on the design specifications of the spring 32, a certain pressure can be fixed as the point at which the mandrel 10 will move downward so that the concave recess will move out of alignment with the plugs 2 and the full diameter of the mandrel will force the plugs outward to full gauge.

In addition, because the seal 40 is located beneath the plugs the increased hydraulic pressures in the chambers 62 and 64 will be exerted between the mandrel and the housing and will be exerted on the curved face 14 of the plugs, assisting in activating them in the radial direction against the bias of the springs 8.

The hydraulic pressure will overcome the spring 32 because the seal 24 prevents the hydraulic pressure of the drilling mud from entering the chamber occupied by the spring beneath the seal 40. The chamber occupied by the floating piston 26 is exposed only to the pressure of the annulus by means of the port 28 and this will be substantially less than the pressure within the mandrel bore 12.

When it is desired to disengage the adjustable plugs, as for instance when the drill string is to be tripped out of the hole, the operator needs only to reduce the pump pressure and the spring 32 will return the mandrel to the illustrated position in which the plugs are opposite the concave recesses and are retracted.

As mentioned before, the ring 52 is provided with check valves which allow the oil in the chamber to flow through in either direction at pre-set pressure differentials. For instance, the check valve may be set at 2,000 PSI in the downward direction and the corresponding check valve set at 500 PSI in the up direction while the spring is designed to compress under a pump pressure of 1,000 PSI. In this hypothetical situation, a pump pressure of 1,000 PSI would be enough to compress the spring but the mandrel would not move until a higher pressure of 2,000 PSI was reached in order to force the oil in the chamber 62 through the downward check valve into the chamber 64. Once this high pressure was used to activate the stabilizer, pump pressures could be allowed to fluctuate during drilling operations and the stabilizer would not deactivate until the pressure dropped sufficiently to allow the spring to exercise an upward pressure in excess of 500 PSI on the fluid passing through the upward directed check valve. Thus, between the high pressure which activates the stabilizer plugs and the low pressure which allows them to deactivate, a substantial range may be established in which the pumps can operate with some fluctuation during the drilling operations.

Figure 4:
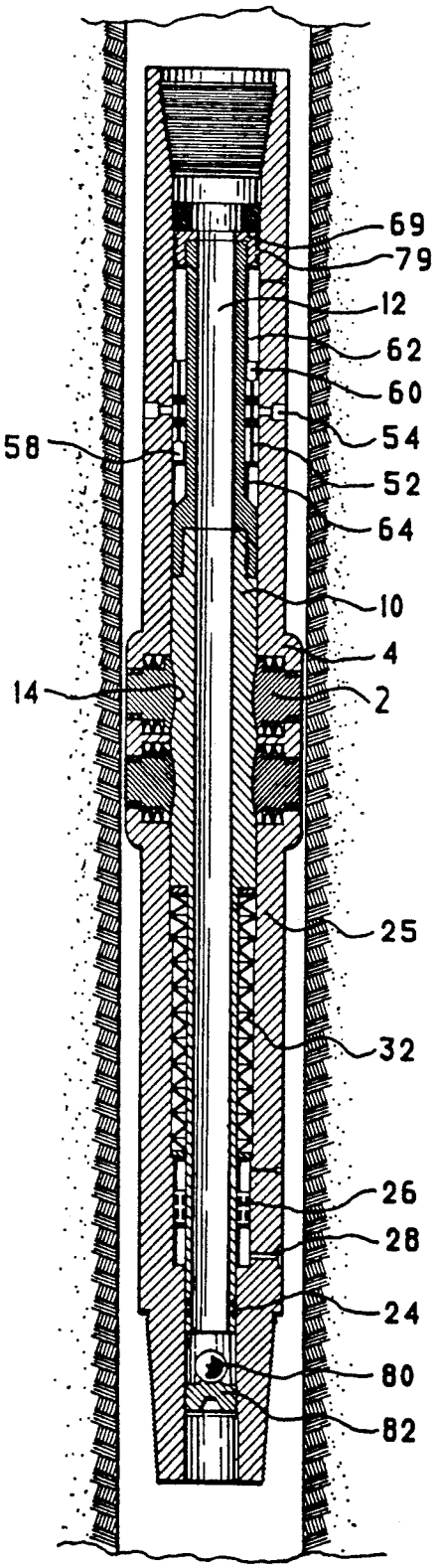
FIG. 4 is a longitudinal cross section of the stabilizer similar to FIG. 1 with an alternative control mechanism.

FIG. 4, a similar but alternative embodiment of the invention is illustrated. Except for minor changes, the same elements and features are designated by the same reference numbers.

However, by comparison, the seal 40 in FIG. 3 has been eliminated at the location beneath the plugs so that the chambers 62 and 64 are not isolated from the pressure in the compartment housing the spring 32.

In addition, the threaded ring 68 of FIG. 3 has been replaced by ring 69 in FIG. 4 which is sealed against the inner diameter of the housing 4 by ring seals 79.

In this configuration, the increased hydraulic pressure in the mud in the bore 12 at the top of the sub will act on the top of the sealed ring 69 tending to press the mandrel downwards while the seal 24 at the bottom of the mandrel prevents the same pressure from equalizing and pressing up from below. When sufficient pressure is achieved, the oil in the chamber 62 will be forced through the downward check valve 60 and into the chamber 64 allowing the mandrel to move downward, thereby activating the plugs 2 by pressing them radially outward. Correspondingly, when the pressure is sufficiently reduced, the spring 32 will force the mandrel upwards with sufficient pressure to drive fluid in the chamber 64 through the upward check valve 58 allowing the mandrel to return to the illustrated position so that the plugs 2 are retracted. In the operation of this embodiment, the hydraulic pressure on the curved inner face 14 of the plugs 2 is substantially the same as the pressure in the annulus on the outer ends of the plug and no hydraulic effect is created tending to expand the plugs in the outward radial direction.

Figure 5:
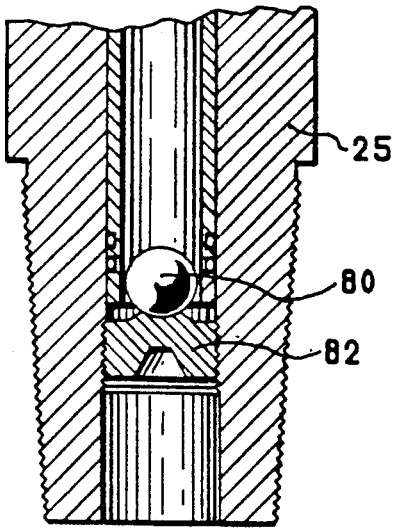
FIG. 5 illustrates the mechanism of FIG. 4 in an other position.

The control mechanism in FIG. 4 is also modified by the presence of a ball 80 supported at the bottom of the sub by a spider 82. As seen in FIG. 5, when the mandrel 10 is in the lower or activated position, the ball 80 forms a substantial restriction in the bore 12 but does not close it. Thus, when the tool is activated the restriction on mud flow will result in a back pressure in the mud line which can be observed by the driller to confirm that the control mechanism has been activated (or conversely that it has been deactivated).

Figure 6:
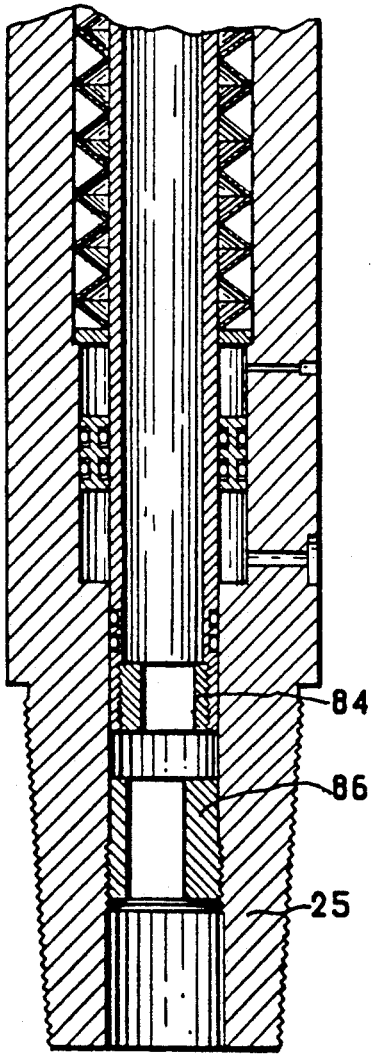
FIG. 6 illustrates an alternative to the design in FIGS. 4 and 5.
Figure 7:
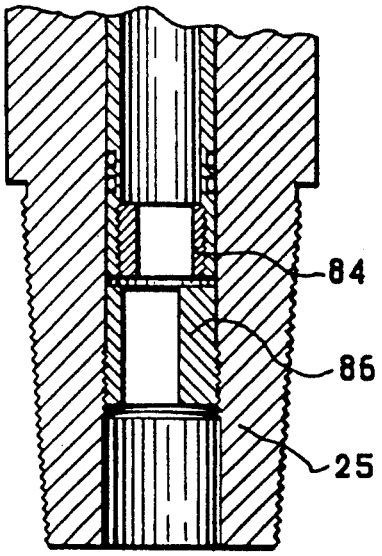
FIG. 7 illustrates the mechanism of FIG. 6 in another position.

FIG. 6 illustrates an embodiment which is an alternative to that in FIGS. 4 and 5 in which a ring 84 is inserted at the bottom of the mandrel and an off set ring 86 is inserted below it in the sub. As illustrated in FIG. 7, when the mandrel is lowered to activate the mechanism, the central openings of the rings 84 and 86 will be off set causing some restriction in the flow which will also create a back pressure which is observable at the drilling rig floor.

Thus, by means of the present invention, down hole devices such as adjustable stabilizers (as described in the illustrated embodiment) as well as packers, dump subs, etc. may be activated or deactivated without bringing the equipment to the surface. Furthermore, the devices may be activated by a simple manipulation of the mud pump pressure and deactivated by a different manipulation of the mud pump pressure and the device may be so regulated that a substantial differential exists providing a range within which the mud pumps may be operated during ordinary drilling operation without affecting the activation or deactivation of the device.

Furthermore, by changing a few parts such as the spring 32 or the preset check valves 58 and 60, the predetermined pressures which activate or deactivate the device may be altered. Other refinements provide means by which activation or deactivation may be signaled to the driller.

It will of course be realized that numerous modification and variations of the described embodiment may be employed without departing from the inventive concept herein. Terms relating to size and direction, such as up and down, are used for descriptive explanation and are not intended to be restrictive.

The embodiments of an invention in which an exclusive property or privilege is claimed are defined as follows:

1. A down hole drilling tool activating mechanism for use in a string of drill type having drilling fluid flowing therethrough and comprising:

a drill sub having ends respectively connectable to adjacent lengths of drill pipe, and having a housing rigidly extending between said ends with a central bore therein to convey drilling fluid;

a mandrel having a central bore to conduct drilling fluids positioned within said drill sub bore and reversibly movable longitudinally therein between a deactivated position and an activated position, in response to drilling fluid pressure;

said mandrel having a firs end of large diameter exposed to drilling fluid pressure in said drill sub bore at the upstream end of said mandrel, and having a second end of reduced diameter smaller than said larger diameter exposed to drilling fluid pressure in said drill sub bore at the downstream end of said mandrel;

seal means positioned between said mandrel and said drill sub housing bore to isolate said large diameter end of said mandrel against drilling fluid pressure from the downstream end of said mandrel.

2. A mechanism as claimed in claim 1 having spring bias means within said drill sub bore tending to urge said mandrel towards the upstream direction against the force of drilling fluid pressure acting on the large diameter end of said mandrel.

3. A mechanism as claimed in claim 1 having a valve ring forming a seal between said mandrel and the bore of said drill sub, said valve ring having a check valve therein to determine the pressure at which fluid moves therethrough to exert pressure on the large diameter portion of said mandrel, and having a second check valve determining a lower pressure at which fluid moves in the reverse direction by pressure exerted by said mandrel at the urging of said spring bias means.

4. A mechanism as claimed in claim 2 having a valve ring forming a seal between said mandrel and the bore of said drill sub, said valve ring having a check valve therein to determine the pressure at which fluid moves therethrough to exert pressure on the large diameter portion of said mandrel, and having a second check valve determining a lower pressure at which fluid moves in the reverse direction by pressure exerted by said mandrel at the urging of said spring bias means.

5. A mechanism as claimed in claim 1 in which said mandrel has cam means adapted to engage follower means whereby said tool is activated or deactivated by longitudinal movement of said mandrel.

6. A mechanism as claimed in claim 2 in which said mandrel has cam means adapted to engage follower means whereby said tool is activated or deactivated by longitudinal movement of said mandrel.

7. A mechanism as claimed in claim 1 in which said follower means are stabilizer plugs movable radially to increase the diameter of said stabilizer when the mandrel is moved to the activated position and retractable to reduce the diameter of said stabilizer when the mandrel is moved to the deactivated position.

8. A mechanism as claimed in claim 2 in which said follower means are stabilizer plugs movable radially to increase the diameter of said stabilizer when the mandrel is moved to the activated position and retractable to reduce the diameter of said stabilizer when the mandrel is moved to the deactivated position.

* * * * *